US009097025B2

(12) United States Patent
Procter et al.

(10) Patent No.: US 9,097,025 B2
(45) Date of Patent: Aug. 4, 2015

(54) PANEL SUPPORT POST

(75) Inventors: Craig Michael Wayne Procter, Kelowna (CA); Timothy David Woods, Kelowna (CA); Harvey Scott Ross, West Kalowna (CA)

(73) Assignee: Craig Procter, Kelowna (CA)

( * ) Notice: Subject to any disclaimer, the term of this patent is extended or adjusted under 35 U.S.C. 154(b) by 135 days.

(21) Appl. No.: 12/659,139

(22) Filed: Feb. 26, 2010

(65) Prior Publication Data

US 2011/0210299 A1 Sep. 1, 2011

(51) Int. Cl.
*E04F 11/18* (2006.01)

(52) U.S. Cl.
CPC ..... *E04F 11/1851* (2013.01); *E04F 11/1812* (2013.01)

(58) Field of Classification Search
USPC ..... 256/24, 31, 69, 65.02, 65.07, 65.14; 52/208; 40/606.01, 612
See application file for complete search history.

(56) References Cited

U.S. PATENT DOCUMENTS

| | | | | | |
|---|---|---|---|---|---|
| 597,684 | A * | 1/1898 | Marsch | 256/24 |
| 704,277 | A * | 7/1902 | Steiner | 256/24 |
| 3,358,969 | A | 12/1967 | Blum et al. | |
| 3,770,245 | A | 11/1973 | Murdock | |
| 3,879,017 | A | 4/1975 | Maxcy et al. | |
| RE28,643 | E | 12/1975 | Blum | |
| 4,054,268 | A | 10/1977 | Sher | |
| 4,380,327 | A * | 4/1983 | Fish | 256/24 |
| 4,390,165 | A | 6/1983 | Murdock | |
| 4,964,618 | A * | 10/1990 | Kennedy et al. | 256/24 |
| 5,404,685 | A * | 4/1995 | Collins | 52/309.7 |
| 5,556,080 | A * | 9/1996 | Vise | 256/24 |
| 5,996,973 | A * | 12/1999 | Campbell | 256/35 |
| 6,029,954 | A | 2/2000 | Murdaca | |
| 6,434,905 | B1 * | 8/2002 | Sprague | 52/474 |
| 6,442,911 | B2 | 9/2002 | Elmer et al. | |
| 6,517,056 | B2 | 2/2003 | Shepherd | |
| 6,581,668 | B1 * | 6/2003 | Oakley | 160/380 |
| 6,766,561 | B1 * | 7/2004 | Cheng | 16/235 |
| 6,877,721 | B2 * | 4/2005 | Calverley | 256/24 |
| 7,559,536 | B1 | 7/2009 | Hansen et al. | |
| 2005/0246981 | A1 * | 11/2005 | Austin | 52/208 |
| 2006/0097237 | A1 * | 5/2006 | McGregor | 256/24 |
| 2010/0224848 | A1 * | 9/2010 | Singer et al. | 256/25 |

FOREIGN PATENT DOCUMENTS

| | | | | |
|---|---|---|---|---|
| WO | WO 2009150525 A2 * | 12/2009 | | E04H 17/16 |

* cited by examiner

*Primary Examiner* — Daniel P Stodola
*Assistant Examiner* — Jonathan Masinick
(74) *Attorney, Agent, or Firm* — Richard D. Okimaw

(57) ABSTRACT

A panel support post comprises a base securable to a mounting surface and an upright member extending substantially vertically from the base. The upright member has a first clamping surface formed by an upright surface thereof. The panel support post further comprises a clamping member having a bottom edge vertically spaced above said base and having a second clamping surface thereon in opposed spaced apart relation to the first clamping surface, the clamping member being drawable towards the first clamping surface. The first and second clamping surfaces are located vertically spaced above the mounting surface so as to support the barrier panel vertically spaced apart from the mounting surface.

14 Claims, 5 Drawing Sheets

PANEL SUPPORT POST

BACKGROUND OF THE INVENTION

1. Field of Invention

The present invention relates to railings in general and in particular to a method and apparatus for supporting railing forming panels above a horizontal surface.

2. Description of Related Art

Railings are commonly known to be located around a perimeter of a deck, balcony or along stairs. Such railings serve a safety function by preventing persons on the deck from inadvertently falling off. A railing has conventionally been formed of a plurality of upright posts spaced apart along the perimeter of the surface to be enclosed. The posts typically have a panel portion therebetween of spindles, mesh or other planar members with top and bottom rails. Railings have traditionally been a trade-off between offering greater security and safety with thicker and stronger materials or being less obstructive to persons trying to look through the railing by utilizing thinner materials.

One solution to reduce the visual obstruction caused by railings has been to utilized glass panels for the main planar portion of the railing. Such solutions may utilize metal or wood posts with corresponding metal or wood top and bottom rails. The use of simple glass panels in place of spindles within a conventional post and railing system, while improving the visibility therethrough, does still obstruct the visibility of occupants. Examples of such use of glass panels within conventional railing frames are illustrated in U.S. Pat. No. 3,879,017 to Maxcy et al., U.S. Pat. No. 4,390,165 to Murdoch and U.S. Pat. No. 6,029,954 to Murdaca. Such attempts have not removed the posts or top and bottom rails entirely which will still impede visibility. Disadvantageously, many such systems also employ rails that have a slot sized to closely receive a specified thickness of glass panel. Accordingly, such systems are not adaptable to differing thicknesses of glass panels without replacement of the rails having such differently sized slots.

Other attempts to solve the difficulty of visibility through railings has been to install a shoe or slot within or on the horizontal surface, such as a deck or balcony, around which the railing is to be installed. The shoe or slot is designed to receive upright glass panels therein to form a barrier extending from the horizontal surface upwards. Examples of such designs are illustrated in U.S. Pat. No. 4,054,268 to Sher, U.S. Pat. No. 4,067,548 to Murphy, U.S. Pat. No. 7,036,799 to Shepherd, and U.S. Pat. No. 7,559,536 to Hansen et al. Although such designs offer improvements in visibility over conventional railing designs, these designs also require the glass panel to extend from or proximate to the floor over which they form a barrier around. Such a design poses difficulties when used around the periphery of an outside deck or balcony. It is known that in such outdoor applications, it is frequently necessary to remove snow or debris from the deck or balcony. Locating the glass panels adjacent to the floor of such a deck or balcony inhibits the removal of such snow or debris by obstructing the space that would conventionally exist under railings.

SUMMARY OF THE INVENTION

According to a first embodiment of the present invention there is disclosed an apparatus for supporting barrier panels to form a railing. The apparatus comprises a base securable to a mounting surface and a post extending substantially vertically from the base. The post has a first clamping surface thereon. The apparatus further comprises a clamping member having a second clamping surface thereon in opposed spaced apart relation to the first clamping surface, the clamping member being drawable towards the first clamping surface so as to clamp the barrier panel therebetween. The first and second clamping surfaces are located vertically spaced apart from the mounting surface so as to support the barrier panel vertically spaced apart from the mounting surface.

The post may extend substantially perpendicularly from the base. The post may extend to less than the height of the barrier panels. The post may extend to a height between one third and one half of the height of the barrier panels.

The mounting surface may comprise a substantially horizontal surface. The posts may space the barrier panels apart from the horizontal surface by a distance of between 3 and 4 inches.

The clamping member may comprise a planar body extending parallel to the post. The clamping member may have a width equal to a width of the post. The clamping member may have a width less than a width of the post.

The apparatus may further comprise at least one fastener extending between the clamping member and the post for drawing the clamping member towards the post. The at least one fastener may comprises two fasteners. The fasteners comprise bolts. The bolts may extend through bores in the clamping member and be threadably received within threaded bores in the post. The threaded bores may be located in the first clamping surface of the post. The fasteners may extend between a gap between adjacent barrier panels wherein each of the first and second clamping surfaces overlaps proximate edges of the glass panels. The fasteners may extend through bores in the barrier panels so as to support an intermediate location of the glass panels.

The apparatus may further comprise a platform extending from the first clamping surface for supporting a bottom edge of the barrier panels. The apparatus may further comprise a platform extending from the second clamping surface for supporting a bottom edge of the barrier panels.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
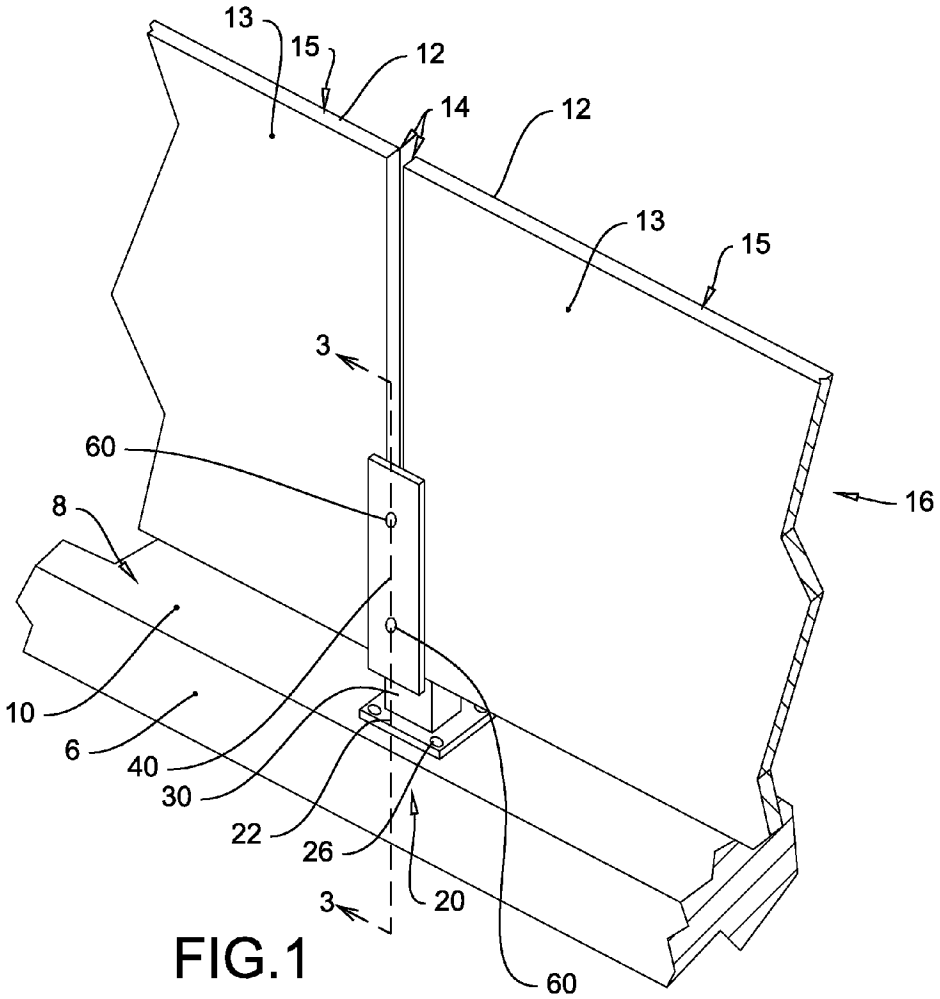
FIG. 1 is a perspective view of a post according to a first embodiment of the present invention supporting a two adjacent glass panels to form a portion of a barrier.

Referring to FIG. 1, an apparatus according to a first embodiment of the invention for supporting a glass panel 12 is shown generally at 20. It will be appreciated that the apparatus may also support other types of barrier panels such as, for example, wood, metal or mesh. One or more of the apparatus 20 may be positioned adjacent to a peripheral edge 6 of a balcony 8 or other structure in conjunction with a plurality of glass panels 12 are to form a barrier 16 therearound. It will be appreciated that although the barrier 16 is illustrated as being formed proximate to the peripheral edge 6 of a balcony 8, the barrier 16 may also be formed proximate to a peripheral edge of any other type of structure, such as, for example, a deck, a patio, a stair case or roof top, as well as at other locations not proximate to the distal edge of the structure to form a division barrier thereon.

The apparatus 20 comprises a base 22, a post 30 and a clamping member 40. The base 22 is secured to a top substantially horizontal surface 10 of the balcony 8. The post 30 extends substantially vertically from the base 22 and the clamping member is drawn towards the post 30 as will be further described below to claim one or more glass panel 12 therebetween.

Figure 2:
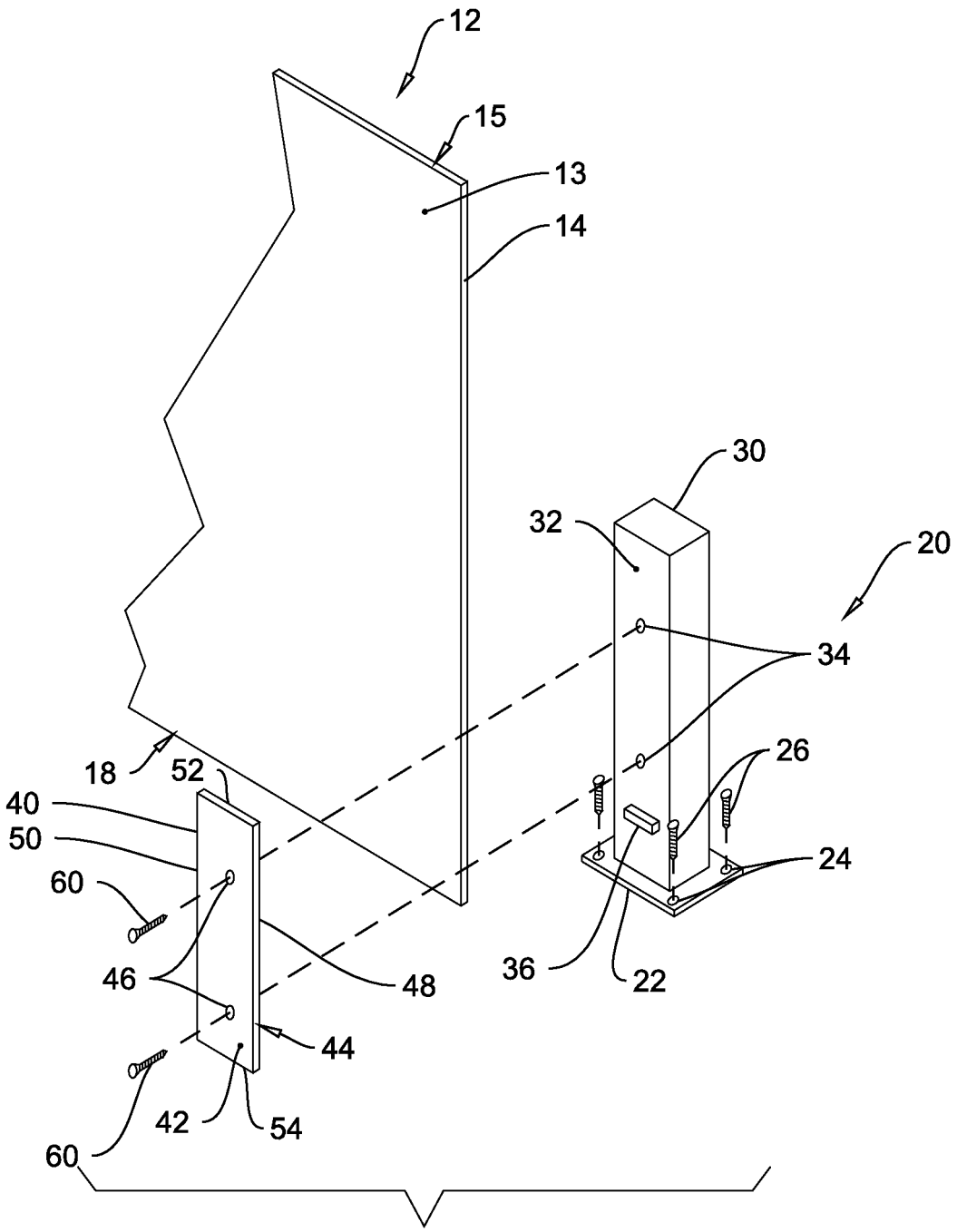
FIG. 2 is an exploded perspective view of the post of FIG. 1 supporting one end of a glass panel.

Turning now to FIG. 2, an exploded view of the apparatus 20 is illustrated. The base 22 comprises a substantially planar member having a plurality of base bores 24 passing therethrough. A plurality of base fasteners 26, such as by way of non-limiting example, bolts, screws and the like are passed through the base bores 24 to secure the base to the horizontal surface 10 of the balcony 8. As illustrated, the base 22 may have a substantially rectangular or square outline although it will be appreciated that other outline shapes may be useful as well, such as, by way of non-limiting example, triangular, circular, oval, polygonal or irregular. It is also illustrated that the base shown in the attached figures has 4 base bores 24 although it will be appreciated that other numbers of fastening bores may be useful as well as required to adequately secure the base 22 to the balcony. The base 22 may also be secured to the balcony 8 by other means than fasteners, such as, for example, adhesives, welding or casting the base into the balcony 10, such as when the balcony is formed of concrete or the like.

The post 30 comprises an upright member extending substantially vertically from the base 22. The post includes a first clamping surface 32 having at least one clamping threaded bore 34 therein. The post 30 may be permanently secured to the base 22 by welding or the like or may optionally be selectively connectable thereto through fasteners, adhesives or any other known method of securing such posts to a base. It will also be appreciated that the post 30 may integrally formed with the base 22 by casting or any other known method. Although the base 22 is illustrated as having a larger cross section than the post, it will be appreciated that the base may be integrally formed with and smaller than the post such that a separate base is not visible to an observer after installation of the apparatus.

The clamping surface 32 receives a rear surface 15 of the glass panel 12 thereon. As illustrated, the first clamping surface 32 may be substantially flat having a vertical planar orientation. It will be appreciated that such an orientation will support a planar glass panel 12 vertically. It will also be appreciated that the first clamping surface 32 may also be oriented at a different angle of inclination than vertical for applications in which the glass panel 12 is desired to be inclined from vertical. Furthermore, the first clamping surface 32 may have a curvature about a vertical axis for applications in which the glass panel 12 is curved form forming a curved barrier. It will be appreciated that in such applications the curvature of the first clamping surface 32 and second clamping surface (as further described below) may be selected to match the curvature of the glass panel 12.

The post 30 may also optionally include a support platform 36 extending therefrom for support a bottom edge 18 of the glass panel 12. It will be appreciated that although the platform 36 is illustrated as having a rectangular cross-section, any suitable shape as desired by a user may be utilized such as, by way of non-limiting example, an L-shaped member having a partition extending from the post 30 for supporting the glass panel 12. The support platform may also optionally extend from the clamping member 40. The support platform 36 may be integrally formed with the post or clamping member 40 or may optionally be securable thereto with fasteners, adhesives or the like. A singe support platform 36 may utilized for each post wherein the support platform 36 supports both adjacent glass panels 12, or optionally separate support platforms 36 may be utilized for each glass panel.

The clamping member 40 comprises a substantially planar member having a second clamping surface 44, an exterior surface 42 and at least one fastener bore 46 extending therebetween. As illustrated, the clamping member 40 may comprise a substantially rectangular body defined by first and second sides, 48 and 50, respectively and top and bottom edges, 52 and 54, respectively. It will be appreciated that other outline shapes of the clamping member may also be utilized such as, for example, circular, triangular, oval, irregular or polygonal. It will also be appreciated that although the clamping member 40 is illustrated as being planar, other shapes of the exterior surface 42 may be useful as well, such as, for example irregular or having a concave or convex curvature.

Clamping fasteners 60 extend through the fastener bores 46 of the clamping member and are threadably received within the clamping threaded bore 34. It will be appreciated that the locations of the fastener bores 46 will correspond to the locations of the clamping threaded bores 34. The clamping fasteners 60 draw the clamping member 40 towards the post so as to grip a glass panel 12 between the first and second clamping surfaces 32 and 44. It will also be appreciated that more than one clamping member 40 may be utilized with each post 30. In particular, each post may have two clamping fasteners 60 wherein each fastener has a single clamping member to be used therewith.

In operation, the base 22 is secured to a horizontal surface 10 by passing the base fasteners 26 through base bores 24 into the horizontal surface. Although the current post 30 is illustrated and described as securing to the horizontal surface 10 of the balcony 8, it will be appreciated that the post may also be securable to a vertical surface 9 of the balcony by locating the base 22 on a side of the post such that the base is substantially perpendicular to the first and second clamping surface 32 and 44. The post 30 may then be secured to the base 22 if necessary in embodiments in which they are not permanently secured to each other. In embodiments in which that base is cast into or otherwise permanently secured to the horizontal surface, the post 30 may then be secured to the cast in place base as necessary. A glass panel 12 is then located proximate to the post with an internal surface 15 abutting or facing the first clamping surface 32. A bottom edge 18 of the glass panel 12 may be rested upon the platform 36 so as to support the glass panel 12 at a predetermined distance above the horizontal surface 10.

The clamping member 40 may then be located proximate to the glass panel 12 with the second clamping surface 44 abutting the exterior surface 13 of the glass panel. The clamping fasteners 60 may then be passed through the fastener bores 46 in the clamping member 40 and into the corresponding clamping threaded bores 34. The glass panel 12 may be positioned with a side edge 14 of adjacent to the clamping fasteners 60 or spaced apart therefrom depending upon the spacing between adjacent glass panels 12. Although only one glass panel is illustrated in FIG. 2, it will be appreciated that in most applications two glass panels will be utilized with one panel to either side of the clamping fasteners 60. The clamping fasteners 60 may then be tightened so as to draw the clamping member 40 towards the post 30 and thereby to draw the second clamping surface 44 towards the first clamping surface 32 and grip the glass panel 12 therebetween.

Figure 3:
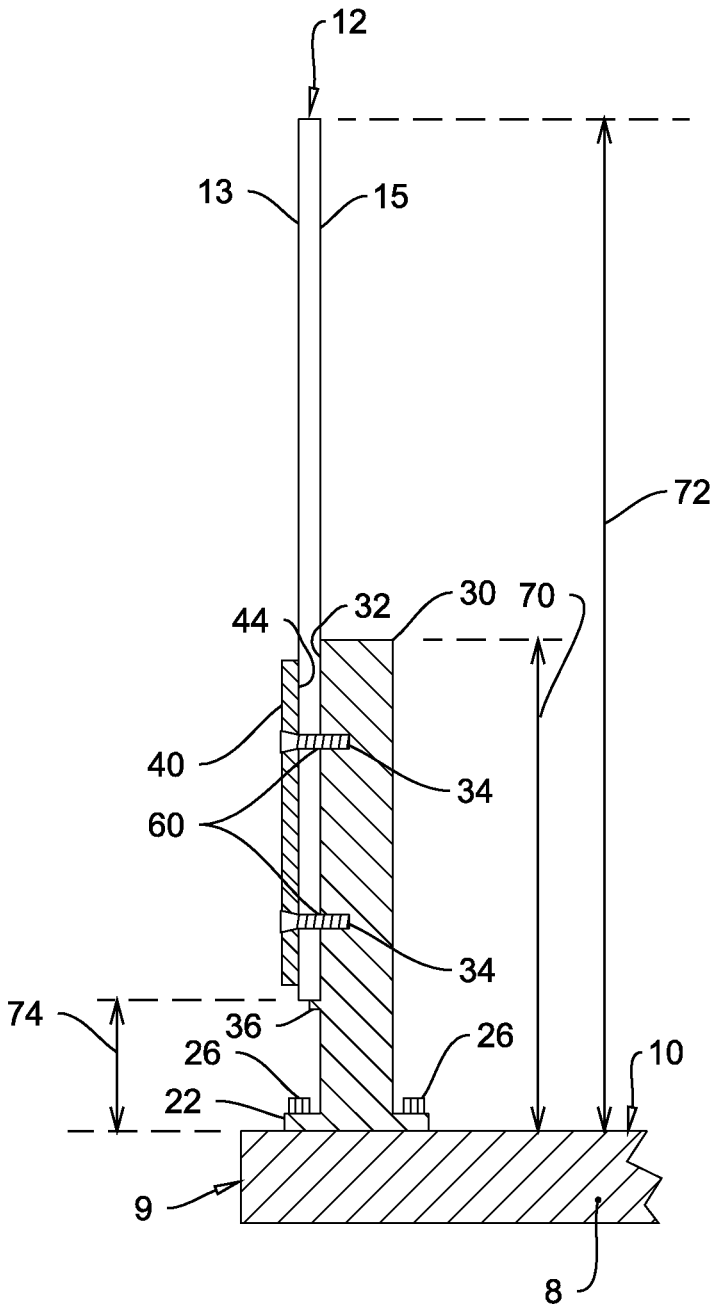
FIG. 3 is a cross-sectional view of the post of FIG. 1 taken along the line 3-3.
Figure 4:
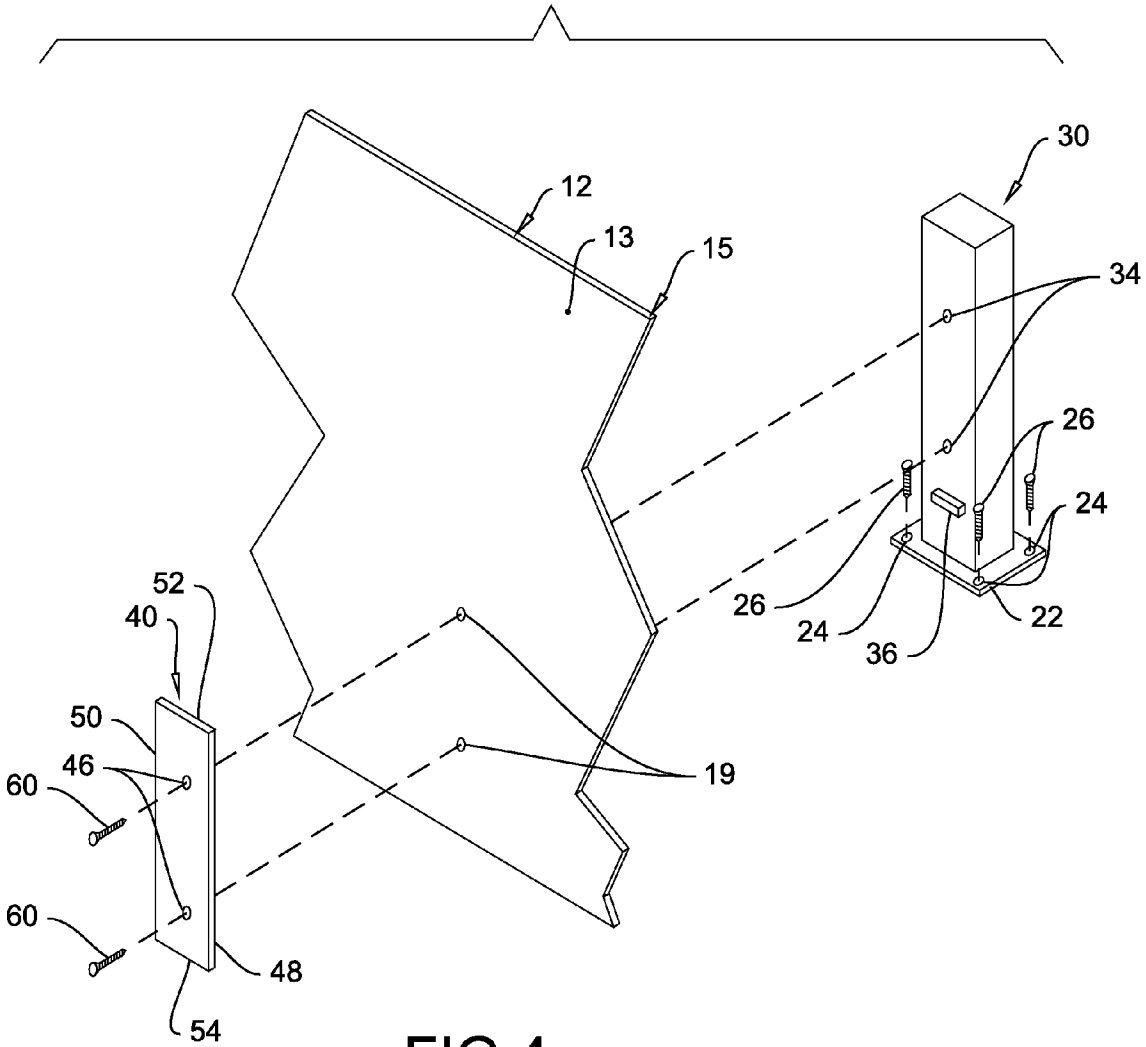
FIG. 4 is an exploded perspective view of the post of FIG. 1 supporting a middle portion of a glass panel.
Figure 5:
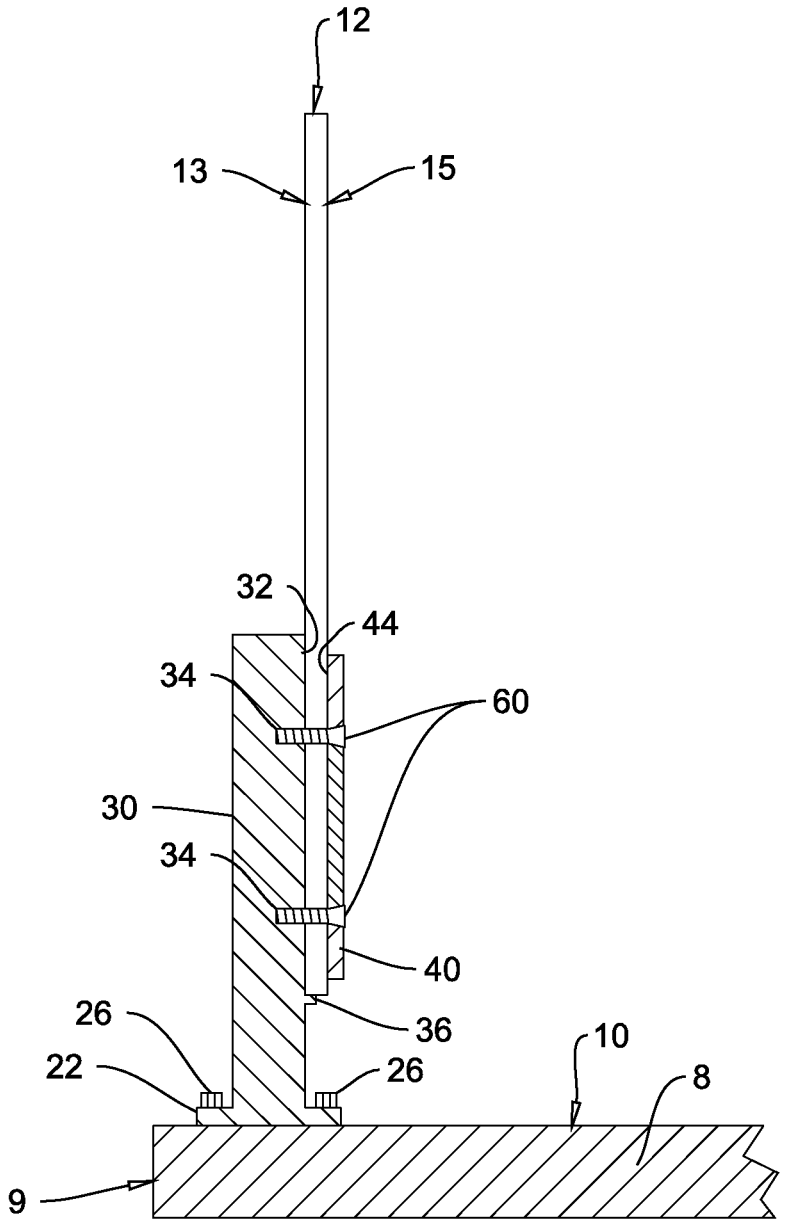
FIG. 5 is a cross-sectional view of the post of FIG. 1 installed with the post proximate to the peripheral edge of the enclosed surface according to a further embodiment of the present invention.

According to an optional embodiment of the present invention, the clamping fasteners 60 may be passed through support bores 19 in the glass panel 12 so as to support a location of the glass panel intermediate the ends as illustrated in FIG. 4. As illustrated in FIGS. 1 through 4, the apparatus 20 may be installed with the post 30 located to the interior of the glass panels 12 with the clamping member 40 located closer to the peripheral edge of the balcony 8. It will also be appreciated that the apparatus 20 may be installed in the reverse orientation with the post 30 located to the outside of the glass panels 12 or more proximate to the peripheral edge 6 of the balcony 8 as illustrate in cross-section in FIG. 5. Locating the posts 30 to the interior of the glass panels 12 will enable the glass panels 12 to be located closer to the peripheral edge of the balcony whereas locating the post to the exterior of the glass panels will reduce any intrusion of the posts into the occupied space defended by the barrier.

The width of the post 30 and the width of the clamping member 40 may be selected to provide a sufficient surface area for the first and second clamping surfaces 32 and 44 to adequately grip the glass panel 12. In particular, it has been found that an overlap of between ½ an inch and 1 inch (19 and 25 mm) of the first and second clamping surfaces 32 and 44 over the glass panel has been adequate although it will be appreciated that other distances may be useful as well depending upon the weight of the panel and the distance between posts. The relationship between the width of the clamping member and the post may also be varied depending upon the geometric relationship between the clamping member and the post and the visual appearance desired by the user. For example, the width of the clamping member 40 defined by the distance between the first and second sides 48 and 50 may be selected to be less than the width of the post 30 so as to reduce the visual interference of the apparatus 20 to persons looking therethrough. It will be appreciated that the width of the clamping member 4 may also be selected to correspond to the width of the post 30. In embodiments in which the apparatus 20 supports a curved glass pane, the clamping member or post that is located to the exterior of the radius may be wider to ensure proper engagement of the first and second clamping surfaces upon the glass panel.

Turning to FIG. 3, the post 30 may have a height indicated generally at 70. Correspondingly the glass panel 12 may have a top height above the horizontal surface 10 generally indicated at 72. Conventional heights for balcony railings are typically between 42 and 48 inches (1067 and 1219 mm) although it will be appreciated that the present post 30 may be useful with railings of different heights as well. The post height 70 may be selected to be substantially less than the railing height 72. In some embodiments, the post height may be selected to be between ½ and ⅓ of the railing height although it will be appreciated that for higher railings and barriers, posts shorter than ⅓ of the height of the railing may also be utilized.

As illustrated in FIG. 3, the glass panel 12 is vertically spaced apart from the horizontal surface by a distance generally indicated at 74. The spacing distance 74 may be selected as desired by the user and dictated by local building codes. In practice it has been found that a distance of between 2 and 4 inches (51 and 102 mm) has been suitable with a distance of between 3 and 4 inches (76 and 102 mm) being commonly preferred.

The apparatus 20 may be formed of any suitable material to provide adequate strength to support the glass panels 12, such as, by way of non-limiting example, mild and stainless steel, aluminium, brass and other alloy metals, plastics, wood and composite materials. It will be appreciated that the The first and second clamping surfaces 32 and 44 may have optional surface treatment, such as a washer or the like applied thereto to assist in the first and second surfaces gripping of the glass panel 12. The surface treatment may comprise a washer or shim located between the first and second clamping surfaces 32 and 44 and the glass panel 12 or may optionally be adhered to the first and second clamping surfaces 32 and 44. It will be appreciated that any washer or shim material utilized between the first and second clamping surfaces 32 and 44 and the glass panel 12 should be selected to withstand the pressures exerted by the first and second clamping surfaces 32 and 44 upon the glass panel 12 so as to not be extruded out from between the clamping surfaces and the glass panel.

While specific embodiments of the invention have been described and illustrated, such embodiments should be considered illustrative of the invention only and not as limiting the invention as construed in accordance with the accompanying claims.

What is claimed is:

1. A system for forming a barrier comprising:

a rigid panel having a bottom edge; and a panel support post for supporting said rigid panel comprising:

a base securable to a mounting surface;

an upright member extending substantially vertically from and rigidly connected to said base, said upright member having a first clamping surface formed by an elongate upright surface thereof, said upright having a height less than a height of the rigid panel;

a panel support platform extending from said first clamping surface having a top and a bottom surface, said top surface supporting said bottom edge of said panel, said bottom surface being oriented towards and spaced above said base; and a clamping member having a bottom edge vertically spaced above said panel support platform and having a second clamping surface thereon in opposed spaced apart relationship to said first clamping surface, said clamping member being drawable towards said first clamping surface, said first and second clamping surfaces being located vertically spaced apart above said mounting surfaces, wherein said first and second clamping surfaces are shaped to correspond to the shape of the rigid panel.

2. The system of claim 1 wherein said upright member extends substantially perpendicularly from said base.

3. The system of claim 2 wherein said upright member has a height of between 14 and 24 inches.

4. The system of claim 1 wherein said mounting surface comprises a substantially horizontal surface.

5. The system of claim 4 wherein said first and second clamping surfaces are vertically spaced above said mounting surface by a distance of between 3 and 4 inches.

6. The system of claim 1 wherein said clamping member comprises a planar body extending parallel to said upright member.

7. The system of claim 6 wherein said clamping member has a width equal to a width of said upright member.

8. The system of claim 6 wherein said clamping member has a width less than a width of said upright member.

9. The system of claim 1 further comprising at least one fastener extending between said clamping member and said upright member for drawing said clamping member towards said upright member.

10. The system of claim 9 wherein said at least one fastener comprises two fasteners.

11. The system of claim 9 wherein said at least one fastener comprises bolts.

12. The system of claim 11 wherein said bolts extend through bores in said clamping member and are threadably received within threaded bores in said upright member.

13. The system of claim 12 wherein said threaded bores are located in said first clamping surface of said upright member.

14. The system of claim 9 wherein said fasteners extend through bores in said barrier panels so as to support an intermediate location of said glass panels.

* * * * *